US005259624A

United States Patent [19]

Puckett

[11] Patent Number: 5,259,624

[45] Date of Patent: Nov. 9, 1993

[54] GOLF BALL WITH SYMMETRICAL DIMPLE PATTERN

[75] Inventor: Troy L. Puckett, Albany, Ga.

[73] Assignee: Geo Golf International PTE Ltd., Singapore, Singapore

[21] Appl. No.: 957,014

[22] Filed: Oct. 5, 1992

[51] Int. Cl.[5] ..... A63B 37/14

[52] U.S. Cl. ..... 273/232

[58] Field of Search ..... 273/232, 213, 235 R, 273/220; 40/327

[56] References Cited

U.S. PATENT DOCUMENTS 4,932,664 6/1990 Pocklington et al. ..... 273/232

5,046,742 9/1991 Mackey ..... 273/232

*Primary Examiner*—George J. Marlo

*Attorney, Agent, or Firm*—James B. Middleton

[57] ABSTRACT

A golf ball has dimples arranged as constrained by a plurality of geometric shapes, and the geometric shapes are located so the sphere of the ball is symmetric about the origin. There is a regular heptagon at each of the poles of the sphere, and bases of irregular pentagons are contiguous with the polar heptagon and surround the ball. Heptagons are then contiguous with the pentagons, followed by more pentagons which extend around the equator. The pentagons at the equator are alternately inverted with respect to one another, and the two hemispheres are alike. A line bisecting the short sides of the pentagons is a geodesic, and one of these is the equator. The equator is the only great circle not intersected by a plurality of dimples.

4 Claims, 2 Drawing Sheets

GOLF BALL WITH SYMMETRICAL DIMPLE PATTERN

FIELD OF THE INVENTION

This invention relates generally to golf balls and the like, and is more particularly concerned with a golf ball that is symmetrical both aerodynamically and geometrically without false seam lines.

BACKGROUND OF THE INVENTION

It is required by the manufacturing technique for golf balls that the ball is composed of two hemispheres. The line along which the mold separates is commonly referred to as the equator or the seam line of the ball. Golf balls include a plurality of dimples on the surface to improve the aerodynamics of the ball, but mold manufacturing techniques and ball manufacturing processes require that no dimple intersects with the seam line.

In the past, golf balls were formed with parallel rows, or circles, of dimples, the circles being concentric with the equator. There were three great circles that were not intersected by dimples, one of these being the seam line of the ball. It was found, however, that such a ball is not aerodynamically symmetrical. Later, a ball was formed having no circumferential paths not intersected by dimples except the seam line of the ball. It was necessary, however, to move dimples from the equatorial area, creating asymmetry.

With the imposition of the symmetry rule by the United States Golf Association, the above discussed balls were unacceptable. The symmetry rule requires that the flight of a ball spinning about an axis through the poles be the same as the flight of a ball spinning about an axis through the equator. To conform to the symmetry rule, golf balls have been formed with a plurality of great circles on the ball that are not intersected by dimples, these great circles being known as "false seam lines". Other golf balls have been modified by having the dimples at the poles shallower than the equatorial dimples.

The above discussed techniques for providing aerodynamic symmetry of a ball have the disadvantage that the aerodynamic drag on the ball is increased. Thus, the prior art does not provide a golf ball having aerodynamic symmetry without increase in the coefficient of drag.

SUMMARY OF THE INVENTION

The present invention provides a golf ball that is geometrically symmetric about the origin and without false seam lines. The ball exhibits aerodynamic symmetry without the necessity for moving dimples, so the depth of the dimples does not have to be varied to achieve aerodynamic symmetry.

The golf ball of the present invention has a surface made up of a plurality of dimples, all the dimples being contained within, or bisected by, constraining geometric shapes. However, the ball includes a plurality of geodesics, and no dimple is intersected by a geodesic. It is important that one of these geodesics is the natural seam line of the ball.

The preferred embodiment of the present invention comprises a surface formed as a geometric prism consisting of sixteen identical and regular heptagons and twenty-eight identical and irregular pentagons as the constraining shapes. The achieving of aerodynamic symmetry with only one seam line and no false seam lines minimize drag on the ball for better distance of the ball.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
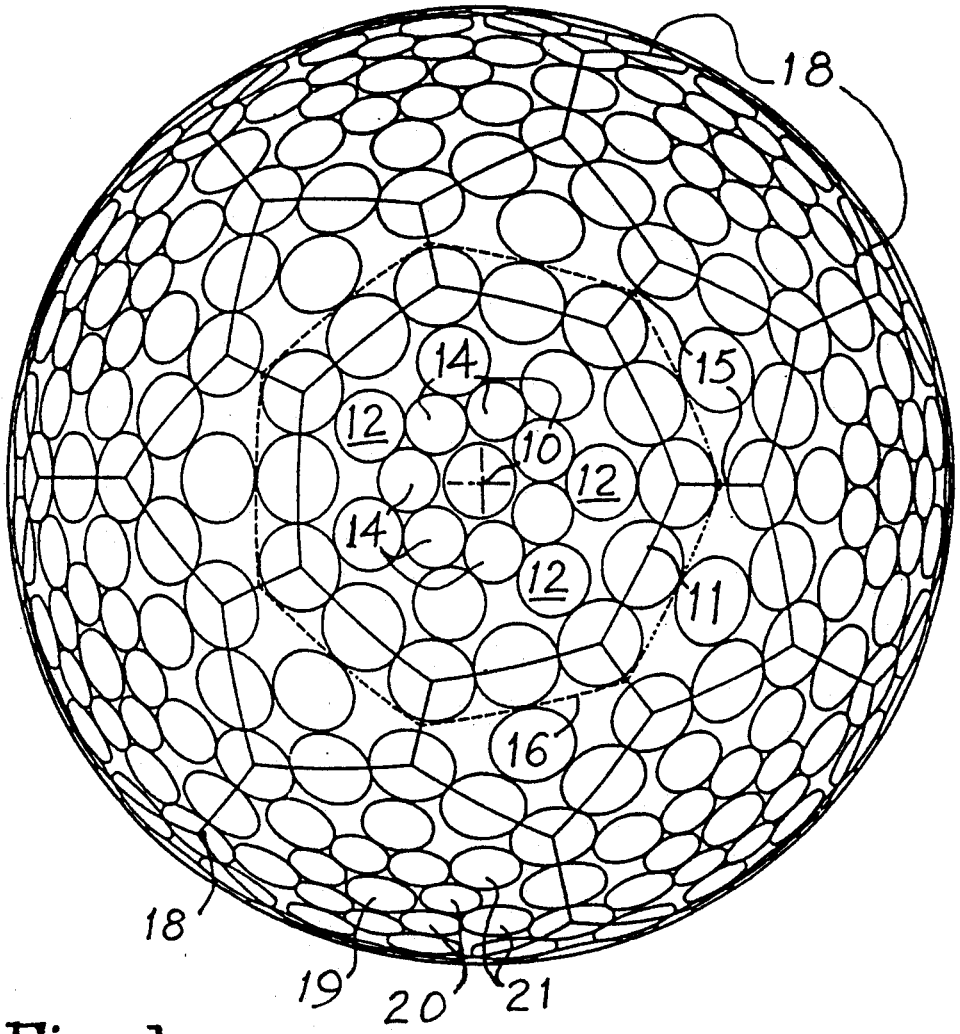
FIG. 1 is a polar view of a golf ball made in accordance with the present invention; and, FIG. 2 is a prespective view showing the equatorial area of the ball illustrated in FIG. 1.

Referring now more particularly to the drawings and to that embodiment of the invention here presented by way of illustration, FIG. 1 shows a golf ball having a polar axis at 10 which is in the center of a dimple. This polar dimple is surrounded by a plurality of dimples of the same size, and these dimples are surrounded by additional dimples. The additional dimples are surrounded by dimples of a polar heptagon 11.

It will be seen in FIG. 1 that a regular heptagon is drawn in as the constraining geometric shape, and this heptagon 11 is constructed by drawing a line through the center of each of the dimples of the polar heptagon 11. The additional dimples 12 are positioned adjacent to the spaced between the dimples of the heptagon 11, and the plurality of dimples 14 are adjacent to the spaces between the dimples 12. All aspects of the polar heptagon 11 are therefore uniform.

The polar heptagon 11 has seven sides; and, each of the sides of the heptagon 11 is also the base of an irregular pentagon. These pentagons will be designated polar pentagons 15, and they surround the polar heptagon 11.

Each of the pentagons 15 has two shorter sides extending from the base, the shorter sides connecting the base to two sides that are the same length as the base. The pentagons 15 therefore have apexes that point down, towards the equator of the ball. A line bisecting the shorter sides of the pentagons 15 will be seen to circumscribe the dimples of the polar heptagon 11, and the bisecting line is a geodesic indicated at 16. Since the pentagons 15 are contiguous with the polar heptagon 11, it will be understood that there are seven of the pentagons 15.

Figure 2:
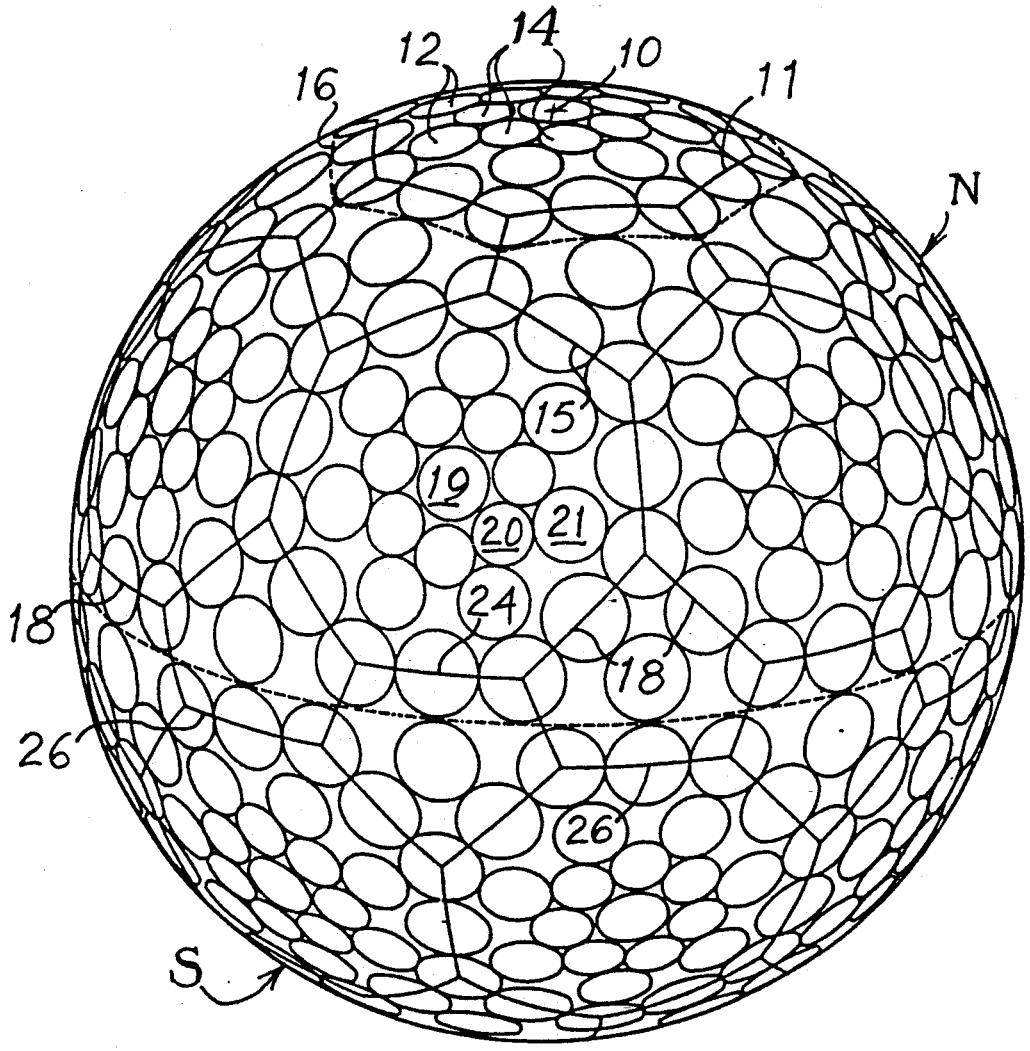

For the next group of dimples, attention is directed to both FIG. 1 and FIG. 2 of the drawings. The next dimples are arranged in regular heptagons 18 like the polar heptagon 11. To distinguish the heptagons 18, they will be referred to as hemispheric heptagons, this term being used to indicate groups of dimples constrained by a heptagonal shape, not at the pole of a ball, but extending around one hemisphere of the ball.

Looking specifically at FIG. 2, it can be seen that there is a dimple 19 at the center of each heptagon, a group of seven dimples 20 surrounding the dimple 19, and a group of seven dimples 21 surrounding, and placed between, the dimples 20. The dimples of the heptagon 18 are then disposed with three on each side of the heptagon 18. It will be readily understood that there are seven of the hemispheric heptagons 18, the heptagons 18 sharing two sides with the polar pentagons 15, and sharing three sides with three equatorial pentagons which will be further discussed below.

In FIG. 2, the equator of the ball is designated at 22, and there is a plurality of equatorial pentagons extending entirely around the equator of the ball. The equatorial pentagons are designated at 24 and 26, the pentagons 24 having an apex that points down as viewed in FIG. 2, and the pentagons 26 having an apex that points up as viewed in FIG. 2.

The pentagons 26 have their two long sides forming the apex contiguous with two sides of the hemispheric heptagons. The pentagons 24 have their bases contiguous with one side of the hemispheric heptagons, the base being parallel to the equator 22. The pentagons 24 and 26 alternate around the circumference of the ball; and, both the pentagons 24 and the pentagons 26 have their shorter sides bisected by the equator 22. Thus, the equator 22 is a geodesic.

With the foregoing discussion in mind, it should be understood by those skilled in the art that the hemisphere of the ball not described is identical to the hemisphere described. The hemisphere just described is designated by N as the northern hemisphere, and the opposite hemisphere is designated at S as the southern hemisphere. Since the equatorial pentagons alternate around the circumference, the arrangement with the hemispheric heptagons is the same in both the northern and southern hemispheres. Further, it will be seen that there is only one great circle on the ball that is not intersected by a plurality of dimples, this one great circle being the equator 22. Since the ball is symmetric about the origin, any axis of rotation will provide substantially equal drag on the ball, and there are no "false seams", or additional great circles to increase the drag on the ball.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. A golf ball comprising two hemispheres, an equator between said two hemispheres, and a plurality of dimples substantially covering the surface of said two hemispheres, said dimples being arranged to fall within a plurality of geometric shapes defined by drawing lines through the centers of peripheral dimples, said plurality of geometric shapes comprising a first plurality of regular polygons and a second plurality of irregular polygons, all of said first plurality of polygons being of the same size and shape, and all of said second plurality of polygons being of the same size and shape, said first and second plurality of polygons being so distributed that said golf ball is symmetric with respect too the center of said ball, said first plurality of polygons consisting of a plurality of regular heptagons, one heptagon of said plurality of heptagons being located at each of the poles of said ball and centered thereon, said second plurality of polygons consisting of a plurality of irregular pentagons, each pentagon of said plurality of pentagons having two short sides of a first length and three longer sides of a second length, said two short sides being separated by one of said longer sides, said plurality of pentagons including a plurality of equatorial pentagons, said equatorial pentagons comprising a first group of equatorial pentagons having bases in the northern hemisphere and parallel to the equator, and a second group of equatorial pentagons having bases in the sourthern hemisphere and parallel to the equator, said equatorial pentagons being so located that said equator bisects the short sides of all of said equatorial pentagons and intersects no dimples.

2. A golf ball as claimed in claim 1, wherein said plurality of pentagons includes seven polar pentagons contiguous with each of said polar heptagons and with one another, said polar pentagons being oriented such that one of said longer sides between said two shorter sides is the base of the pentagon, and said base is coincident with a side of said polar heptagon.

3. A golf ball as claimed in claim 2, and further including a plurality of hemispheric heptagons contiguous with said plurality of polar pentagons and with said equatorial pentagons, said hemispheric heptagons being contiguous with one another and extending around a hemisphere of said ball.

4. A golf ball as claimed in claim 3, wherein said polar pentagons are so located that a line bisecting the shorter sides of said polar pentagons intersects no dimples and circumscribes said polar heptagon.

* * * * *